US007836743B1

(12) United States Patent
McCoy

(10) Patent No.: US 7,836,743 B1
(45) Date of Patent: Nov. 23, 2010

(54) SYSTEM AND METHOD FOR MATERIAL BENDING

(76) Inventor: Danny McCoy, 284 Charles Rd., Pataskala, OH (US) 43062

( * ) Notice: Subject to any disclaimer, the term of this patent is extended or adjusted under 35 U.S.C. 154(b) by 251 days.

(21) Appl. No.: 11/936,619

(22) Filed: Nov. 7, 2007

(51) Int. Cl.
*B21D 11/00* (2006.01)

(52) U.S. Cl. ..... 72/319

(58) Field of Classification Search ..... 72/310, 72/314, 315, 319, 387, 388, 452.2, 450, 457, 72/458, 479, 482.1, 482.6
See application file for complete search history.

(56) References Cited

U.S. PATENT DOCUMENTS 1,801,271 A * 4/1931 Heider ..... 157/1.5
2,052,355 A * 8/1936 Lippard ..... 72/311
2,160,441 A * 5/1939 Peters ..... 72/306
2,476,658 A * 7/1949 Greiner ..... 65/281
4,402,389 A * 9/1983 Adams et al. ..... 192/134
4,910,986 A * 3/1990 Funkhouser ..... 72/31.02
5,775,162 A * 7/1998 Ward ..... 72/389.3

* cited by examiner

*Primary Examiner*—Edward Tolan
(74) *Attorney, Agent, or Firm*—Ronald J. Koch

(57) ABSTRACT

An improved system and method for material bending comprises first handle 51, second handle 61, pivot rod 70, roller 80, and brace 82.

1 Claim, 4 Drawing Sheets

SYSTEM AND METHOD FOR MATERIAL BENDING

BACKGROUND AND SUMMARY

The present invention relates generally to devices for bending materials and specifically to sheet metal benders. Sheet metal brakes ("brake" or "brakes" herein) are known in the art. A typical brake system is of the type manufactured by "TAPCO" (trademark), such as model "Pro 14" as depicted in FIG. 4. Normal operation thereof comprises a user inserting sheet metal (not shown) in between locking anvil 5 and base hinge 6. The user pulls handle 1 towards him or her which rotates cam shaft 3 which engages pivot arms 4 which push locking anvil 5 downward thereby clamping the sheet metal in place.

Next, the user grasps lifting handle 8 and thereby rotates moving hinge 7 and bends the sheet metal. After bending, lifting handle 8 is released. Next, the user releases handle 1, which releases the sheet metal. The user can then reposition the sheet metal and repeat the above procedure to attain desired bending pattern in the material. Typical brake systems as described are problematic because they require two hands to operate. One hand must be dedicated to the operation of handle 1. This slows the process.

An improved system is presented that overcomes this problem. The present invention is advantageous because one of the user's hands are freed. The function of locking and unlocking the sheet metal with handle 1 is accomplished with the user's foot.

REFERENCE NUMERALS IN DRAWINGS

Figure 1:
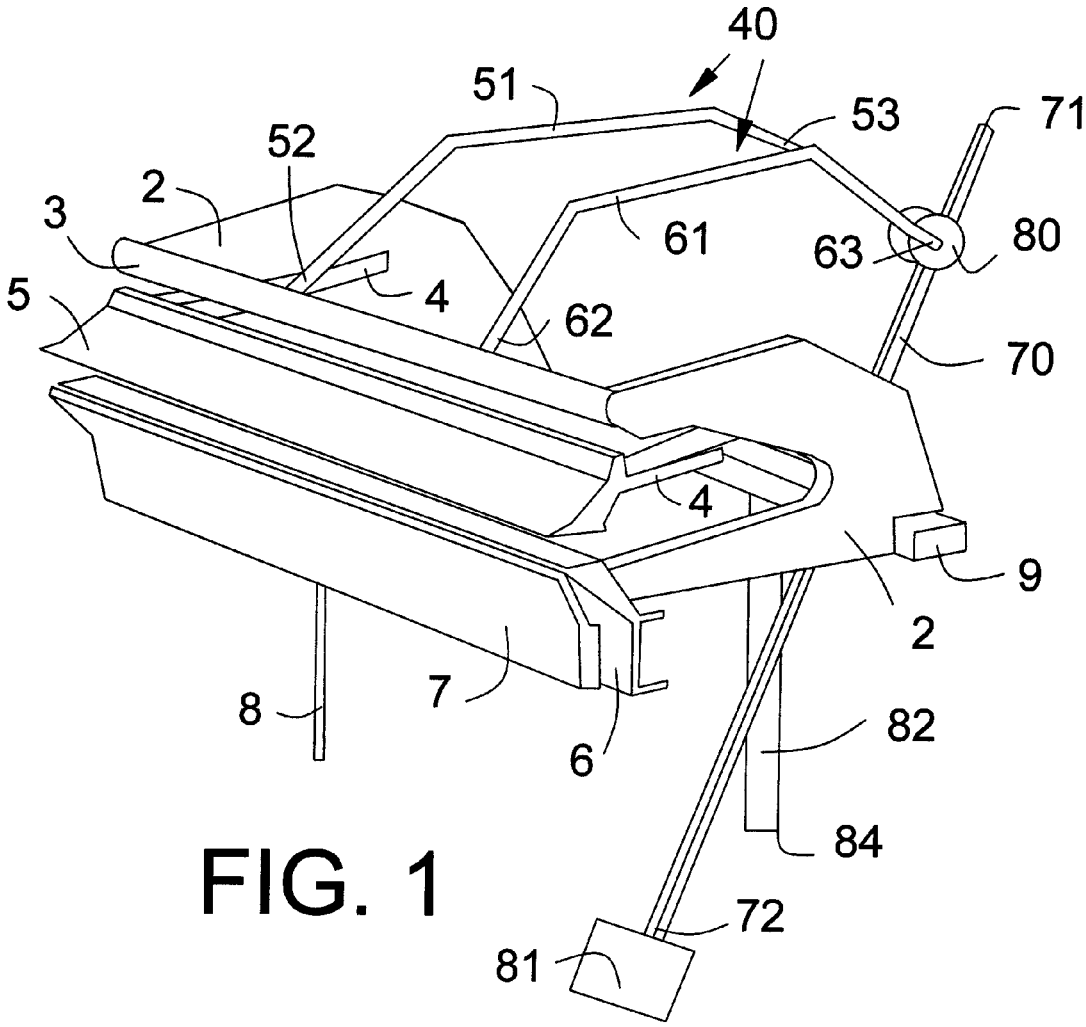
FIG. 1 depicts a perspective view of the invention.

The table below lists the reference numerals employed in the figures, and identifies the element designated by each numeral.

1 Handle Assembly of conventional brake 1
2 C-Casting 2
3 Cam Shaft 3
4 Pivot Arms 4
5 Locking Anvil 5
6 Base Hinge 6
7 Moving Hinge 7
8 Lifting Handle 8
9 Back Rail 9
40 Handle Assembly 40
51 First Handle 51
52 first end 52 of first handle
53 second end 53 of first handle
61 Second Handle 61
62 first end 62 of second handle
63 second end 63 of second handle
70 Pivot Rod 70
71 Upper end 71 of pivot rod
72 Lower end 72 of pivot rod
80 Roller 80
81 Foot Plate 81

82 Brace 82
83 upper end 83 of brace
84 lower end 84 of brace

DETAILED DESCRIPTION

Handle 1 of a conventional brake is replaced by handle assembly 40 (FIGS. 1, 2) which is comprised of two handles, first handle 51 and second handle 61. The handle assembly 40 forms a cantilever having the shape depicted in FIG. 1, 2; It is to be understood that the definition of cantilever, in addition to dictionary meaning and definitions used in the art, includes the shape of handle assembly 40 as depicted.

Pivot rod 70 has upper and lower ends, 71 & 72, respectively. First ends 52, 62 of first and second handles 51, 61 fixedly engage the cam shaft 3 of a brake. Second ends 53, 63 of first and second handles 51, 61 slidingly engage upper end 71 of pivot rod 70 through roller 80.

Figure 3:
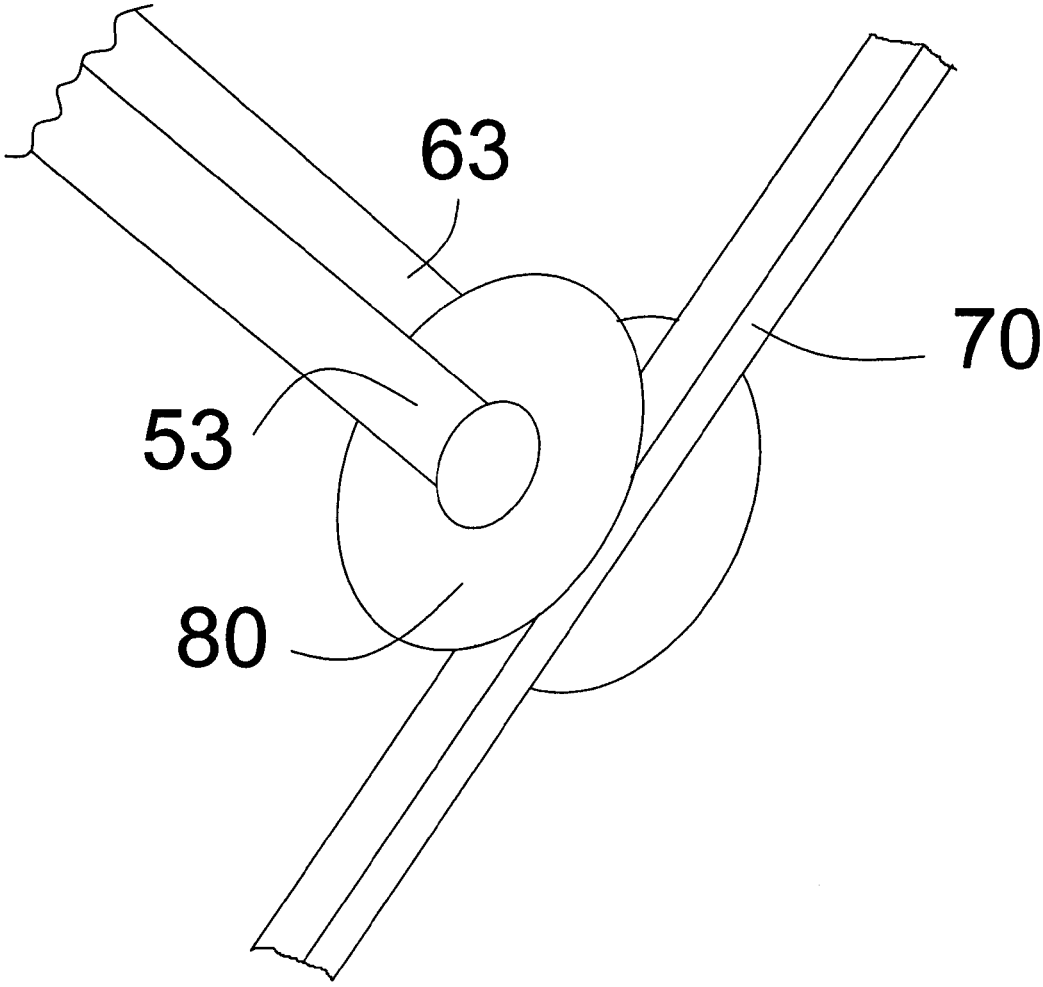
FIG. 3 depicts roller 80

Generally, a roller is supplied operable to engage pivot rod 70 so as to transverse it longitudinally as pivot rod 70 rotates about brace 82. Thus, force is transferred from lower end 72 of pivot rod 70 to handle assembly 40. It is preferred that roller 80 be constrained laterally with respect to pivot rod 70 as it rolls. This can be accomplished by a roller with flanges, or a channel formed within the rolling surface of the roller. A preferred embodiment comprises a roller 80 (FIG. 3) having lateral flanges to constrain pivot rod 70. Roller 80 rotatedly engages second ends 53, 63 of first and second handles 51, 61.

Pivot rod 70 is pivotably engaged to brace 82 at point operable to maximize the freedom of movement of pivot rod 70. This can be accomplished in various ways. A preferred embodiment comprises pivot rod 70 bolted to brace 82 so as to allow rotation of upper end 71 of pivot rod with respect to brace 82. Other ways to accomplish this include clevis pins and cotter pins and other methods known in the art.

Upper end 83 of brace 82 is fixedly secured to the back rail 9 of a brake. Brace 82 is positioned vertically below back rail 9 so as to engage pivot rod 70. Preferably, foot plate 81 is fixedly secured to lower end 72 of pivot rod 70. A preferred embodiment (FIGS. 1,2) comprises pivot rod 70 being straight. However, foot plate 81 is not necessary. The user's foot can engage lower end 72 of pivot rod in stead of roller 80.

Another preferred embodiment (not shown) comprises pivot rod 70 being bent so as to place foot plate 81 closer to the user's foot. This provides for ease of use and greater application of force to pivot rod 70.

As depicted in the figures, the shape and dimensions of handle assembly 40 are relative to the size of the brake being retrofitted. Therefore, the actual dimensions and shape will be apparent to those in the art.

Figure 2:
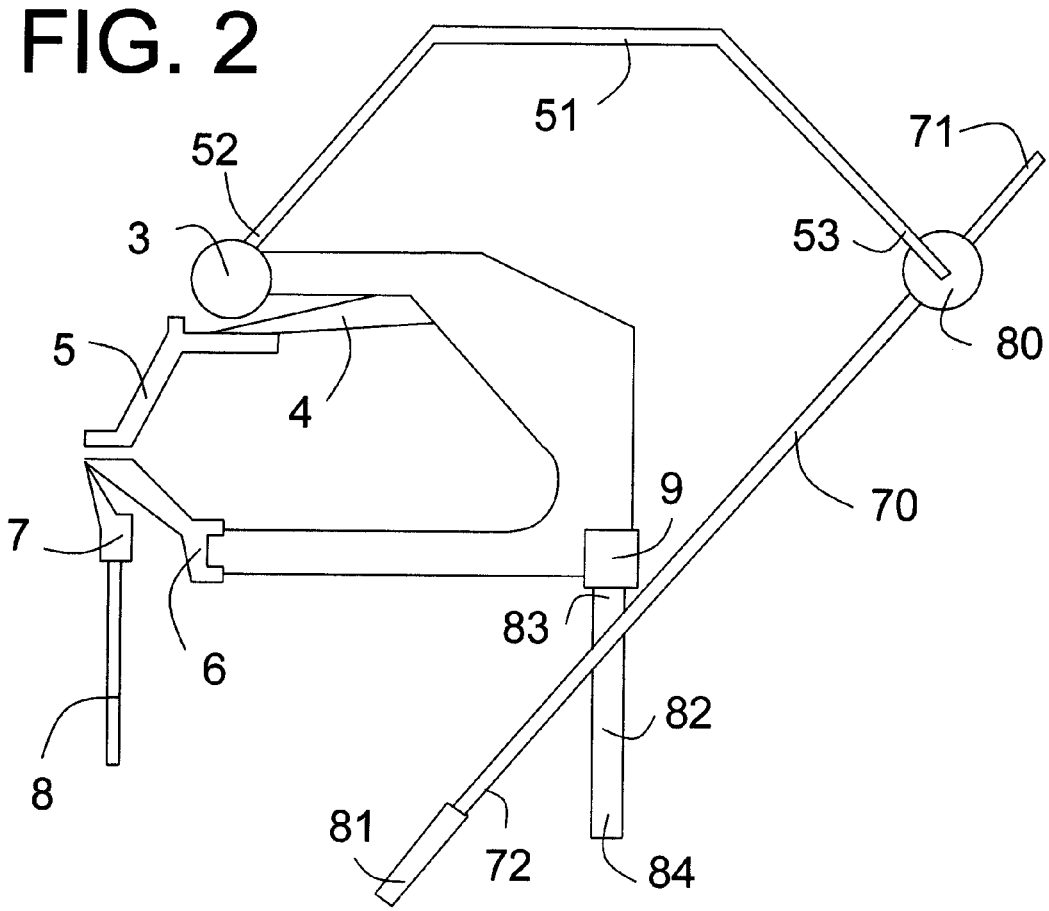
FIG. 2 depicts a side view of the invention.
Figure 4:
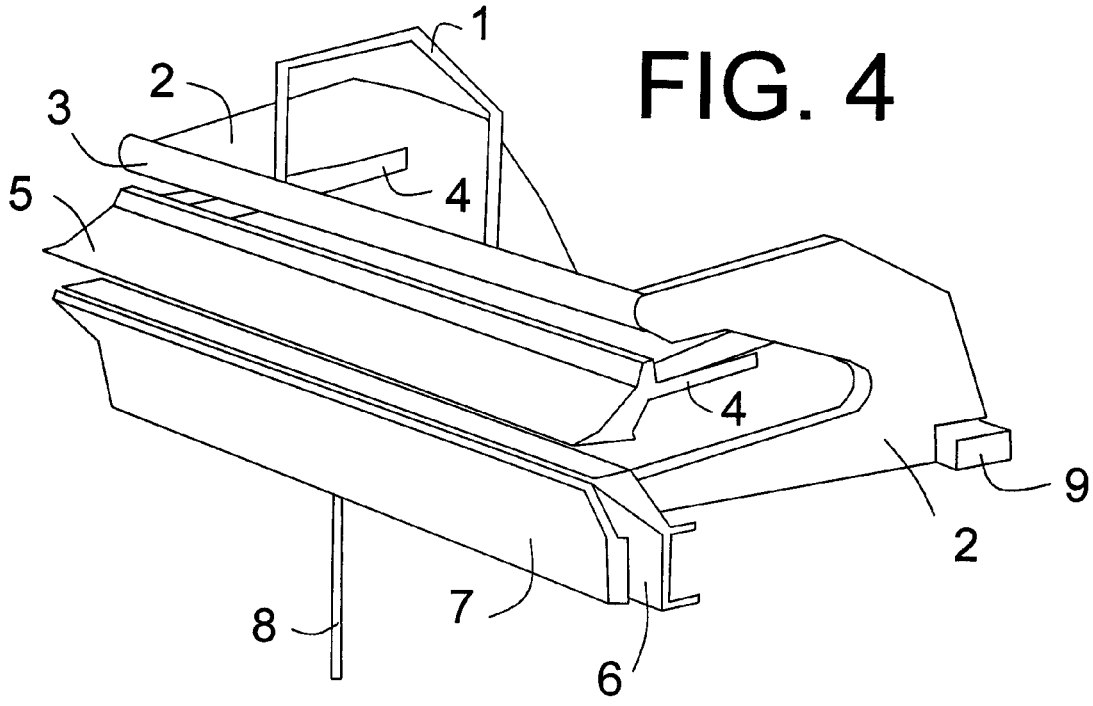
PRIOR ART FIG. 4
FIG. 4 depicts a perspective view of the prior art.

As depicted in FIG. 2, a preferred embodiment comprises roller 80 being to the right of (or behind) c-casting 2. Handle assembly 40 engages cam shaft 3 analogous to the way handle 1 engages cam shaft 3 in the traditional configuration depicted in FIG. 4.

In operation, the user depresses foot plate 81. This causes pivot rod 70 to rotate about brace 82. Pivot rod 70 engages roller 80 which in turn causes handle assembly 40 to rotate cam shaft 3. Thus, handle assembly 40 causes cam shaft 3 to rotate as roller 80 travels longitudinally along pivot rod 70. Otherwise, the bending operation is the same as the traditional method.

What is claimed is:

1. A material bending apparatus comprising:

a handle assembly comprising, a first handle having first and second ends, and a second handle having first and second ends;

a pivot rod having an upper and a lower end;

a brace having an upper end and a lower end;

said handle assembly forming a cantilever such that said first ends of said first and second handles fixedly engage a cam shaft of a brake and said second ends of said first and second handles slidingly engage said upper end of said pivot rod;

said pivot rod being pivotably engaged to said brace;

said upper end of said brace being fixedly connected to a back rail of a brake; whereby a user engages said lower end of said pivot rod with the user's foot causing said pivot rod to rotate about said brace, and causing said pivot rod to slidingly engage said handle assembly, and causing said handle assembly to engage the cam shaft of the brake so as to rotate the cam shaft of the brake.

* * * * *